US006264215B1

(12) United States Patent
Carlson et al.

(10) Patent No.: US 6,264,215 B1
(45) Date of Patent: Jul. 24, 2001

(54) SNOWBOARD INSTRUCTIONAL ATTACHMENT

(76) Inventors: Caleb Carlson, 223 Inspiration Way; Terry D. McLeod, 1102 Chestnut, both of Sandpoint, ID (US) 83864

( * ) Notice: Subject to any disclaimer, the term of this patent is extended or adjusted under 35 U.S.C. 154(b) by 0 days.

(21) Appl. No.: 09/251,389

(22) Filed: Feb. 17, 1999

(51) Int. Cl.[7] ..... B62M 29/00

(52) U.S. Cl. ..... 280/14.21; 280/608; 280/609; 280/809

(58) Field of Search ..... 280/14.21, 608, 280/609, 809, 816, 28, 814

(56) References Cited

U.S. PATENT DOCUMENTS

| | | | | |
|---|---|---|---|---|
| 3,643,978 | * | 2/1972 | Westberg | 280/28 |
| 4,002,349 | * | 1/1977 | Dopp | 280/11.37 |
| 5,163,550 | * | 11/1992 | Hawk | 206/315.1 |
| 5,312,258 | * | 5/1994 | Giorgio | 434/253 |
| 5,356,168 | * | 10/1994 | Ozburn | 280/605 |
| 5,664,808 | * | 9/1997 | Whidden et al. | 280/815 |
| 5,826,908 | * | 10/1998 | McBride | 280/814 |
| 5,967,314 | * | 10/1999 | McGovern | 206/315.1 |
| 6,007,101 | * | 12/1999 | Pritchard et al. | 280/809 |
| 6,012,734 | * | 1/2000 | Skedeleski | 280/610 |
| 6,012,739 | * | 1/2000 | Weiss et al. | 280/814 |

* cited by examiner

*Primary Examiner*—J. J. Swann
*Assistant Examiner*—J. Allen Shriver
(74) *Attorney, Agent, or Firm*—Wells, St. John, Roberts, Gregory & Matkin, P.S.

(57) ABSTRACT

A snowboard instructional attachment is described including a slider plate that is formed to include a top surface and a bottom surface. The top surface is configured to be secured to a base surface of a snowboard and the bottom surface is configured to engage and slide across snow to prevent the side edge of the snowboard from digging into the snow. The slider plate further includes a leading edge joining the bottom surface. It extends upwardly from the bottom surface and is configured to extend above the top deck surface of a snowboard when mounted thereto. A clamp is preferably mounted to the slider plate and is configured to releasably secure the slider plate to a snowboard with the top surface engaging the base surface of the snowboard.

14 Claims, 7 Drawing Sheets

SNOWBOARD INSTRUCTIONAL ATTACHMENT

TECHNICAL FIELD

The present invention relates to instructional aids for attachment to snowboards.

BACKGROUND OF THE INVENTION

Snowboarding is a growing sport that is attracting both experienced skiers and novice snowboarders alike. Many ski resorts have included training programs designed to teach the basic techniques involved in snowboarding. In the past, however, many have been discouraged from learning snowboarding because of the frequent spills that are expected during the learning process.

Spills that occur during snowboard training may often be attributed to the tendency for the novice snowboarder to lean forwardly on the snowboard during stopping or turning maneuvers. The downhill shift of body weight will typically result in the downhill edge of the snowboard digging into the snow. The end result is that the snowboarder will topple forwardly in an embarrassing or sometimes injurious spill. This situation can occur frequently enough that the erstwhile snowboarder will become discouraged from taking further lessons. Further, even if the novice snowboarder continues with lessons, valuable training time is taken up with such spills.

It is an objective of the present invention to provide an attachment for snowboards that can be used in training to avoid spills of the nature described above.

It is a further objective to provide such an attachment that may be secured to existing snowboards without requiring special modification of the snowboard.

It is a still further objective to provide such an attachment that may be easily and quickly mounted and dismounted to existing snowboards.

A yet further objective is to provide such an attachment that may be provided in different sizes for juvenile and adult size snowboards.

The above and yet further objects and advantages may be understood from the following description which, taken with the accompanying drawings and claims, describe the presently preferred mode of carrying out the present invention.

BRIEF DESCRIPTION OF THE DRAWINGS

Preferred embodiments of the invention are described below with reference to the following accompanying drawings.

FIG. 10 is a top plan view of the mounting arrangement shown in FIG. 8;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 9:
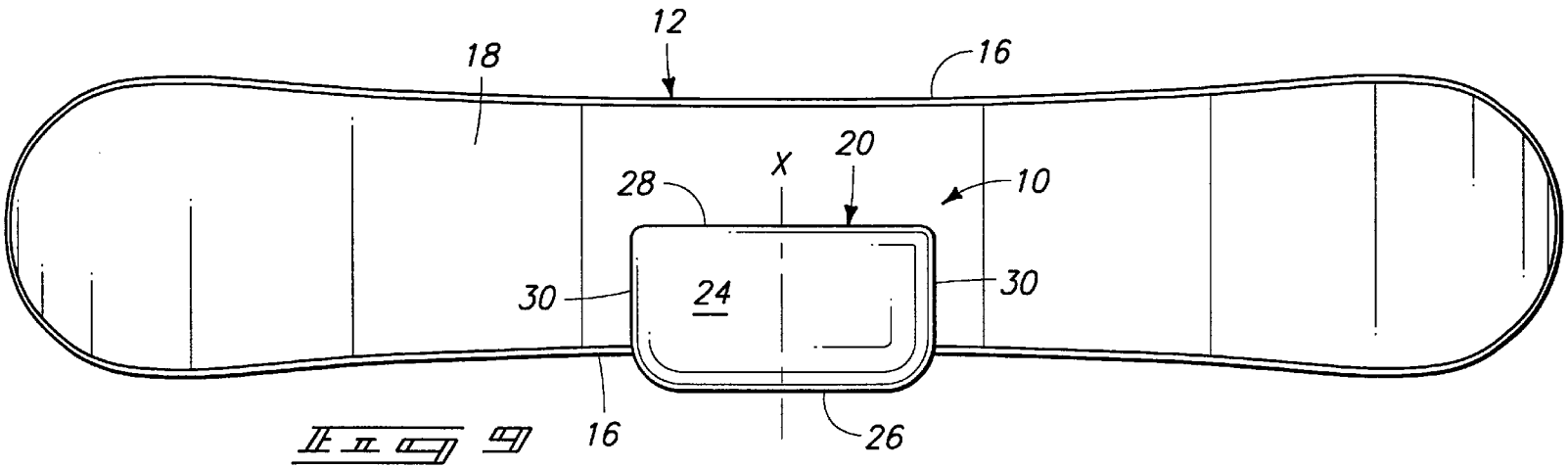
FIG. 9 is a bottom plan view of the mounting arrangement shown in FIG. 8.

Preferred forms of the present snowboard instructional attachment are identified in the accompanying drawings by the reference numeral 10. The attachment 10 is intended to be releasably secured to existing forms of snowboards 12, which typically include a top deck surface 14, a side edge 16, and a base 18. In commercially available snowboards two parallel side edges 16 extend longitudinally along the board. The edges 16 are usually slightly curved, forming a concave configuration when observed from above or below the board as shown in FIGS. 9 and 10.

Figure 2:
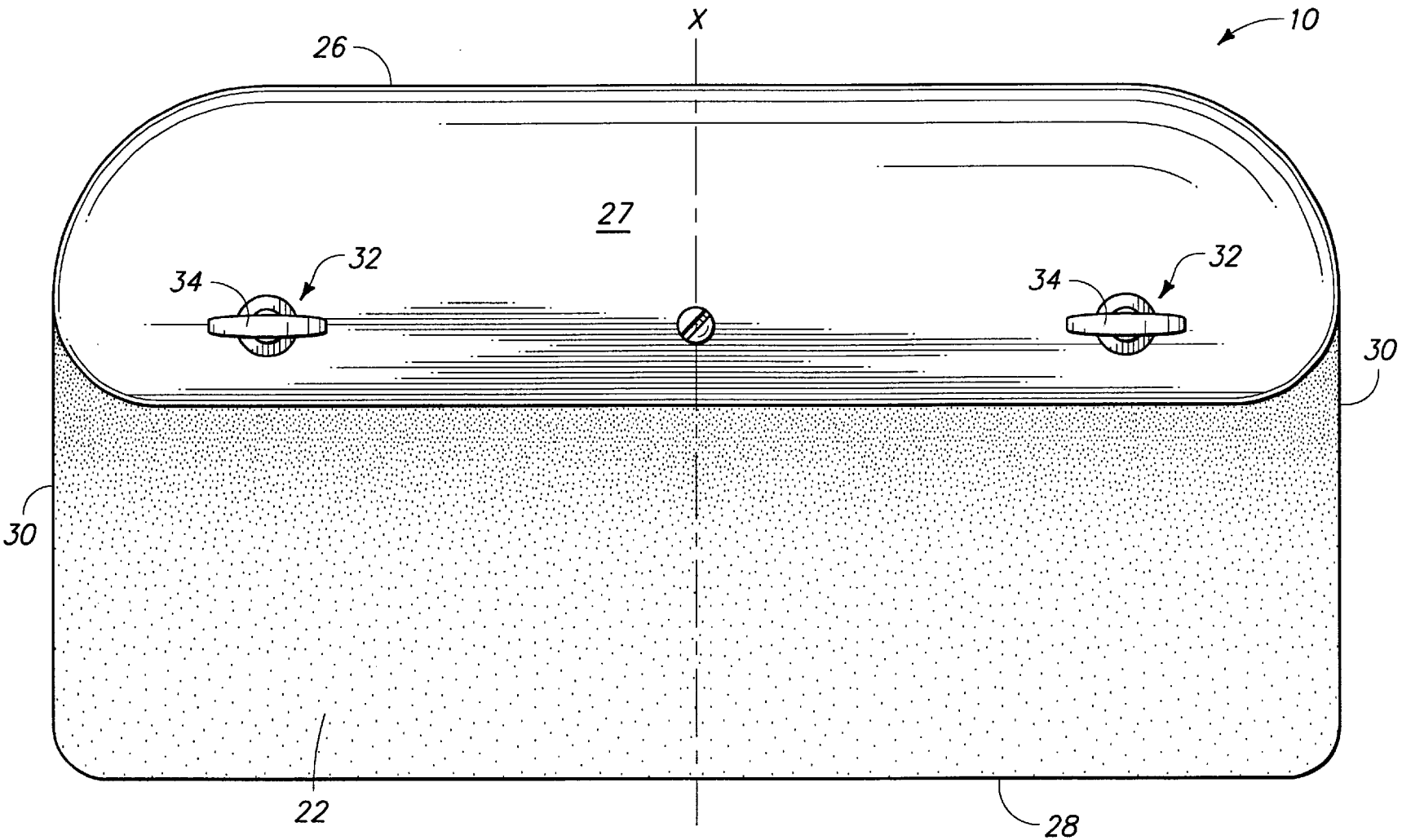
FIG. 2 is a top plan view of a preferred embodiment.
Figure 5:
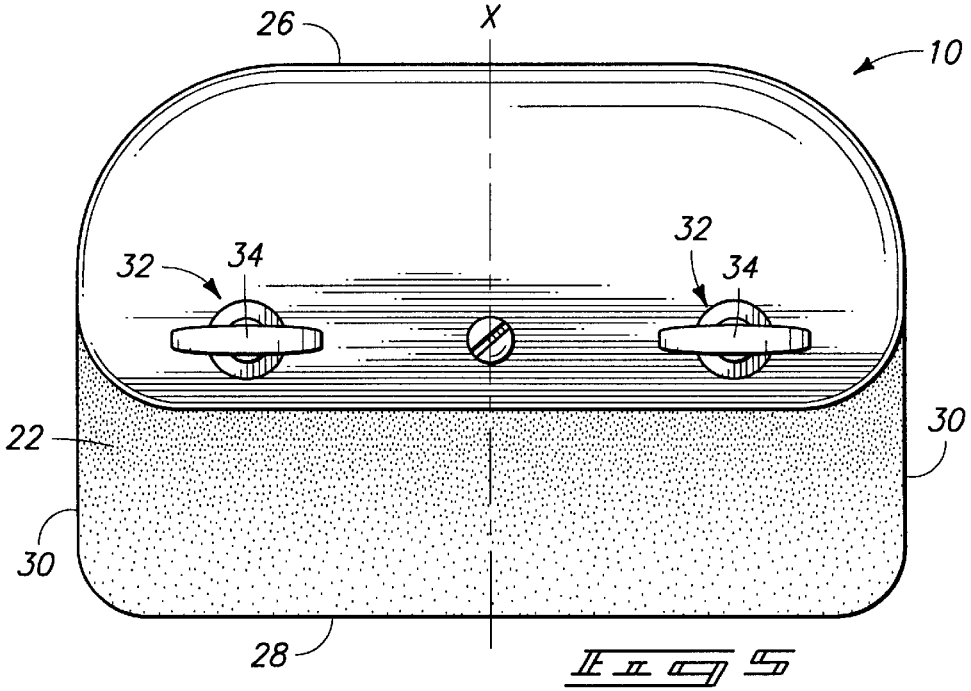
FIG. 5 is a top plan view of an alternate embodiment of a smaller scale than the embodiment shown in FIG. 1.
Figure 6:
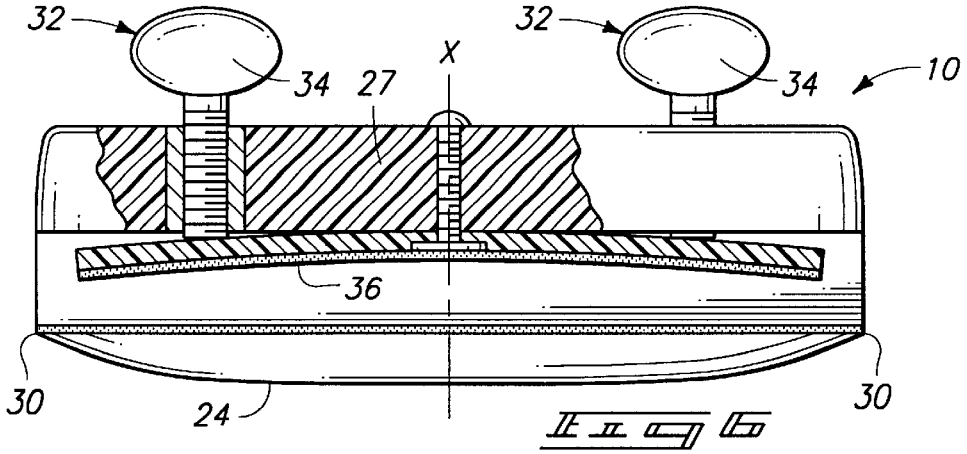
FIG. 6 is a partially fragmented side elevational view of the FIG. 5 embodiment.

The present attachment 10 may be provided in different sizes, as may be observed by comparing FIGS. 2 and 5. Features of the attachments 10, except for size differences, may remain virtually identical. Further discussion of one embodiment will thus serve as description of other embodiments and like reference numerals will be used for the two examples shown.

Preferred forms of the present attachment include a slider plate 20 that may be formed using conventional forming techniques from conventional materials such as metal, wood, or plastics. In presently preferred forms, the plate 20 will be produced using an appropriate plastic material by a conventional technique such as injection molding.

Figure 1:
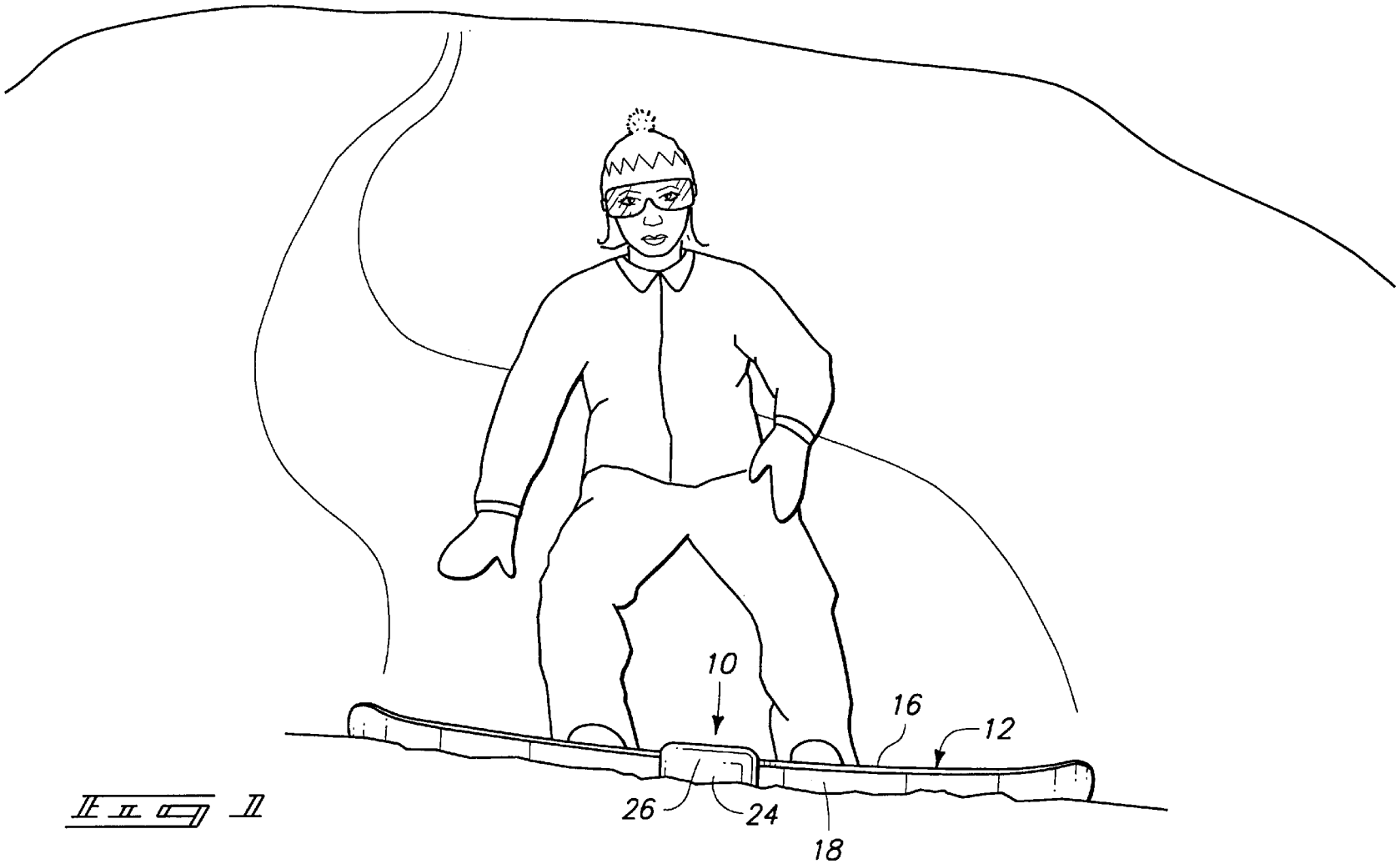
FIG. 1 is a perspective view showing a snowboarder using a preferred form of the present invention.

Structurally, the preferred slider plate will include a top surface 22 and a bottom surface 24. The top surface 22 is preferably configured to be secured to a snowboard base 18 and the bottom surface is configured to engage and slide across snow (FIGS. 1, 12).

Preferred forms of the slider plate will also include a leading edge 26, joined with and extending upwardly from the bottom surface 24. The preferred leading edge 26 is configured to extend above the top deck surface 14 of a snowboard when mounted thereto, substantially as shown in FIG. 12. A trailing edge 28 is also formed along the slider plate, in opposition to the leading edge, and opposed end edges 30 join the leading and trailing edges 26, 28.

Figure 4:
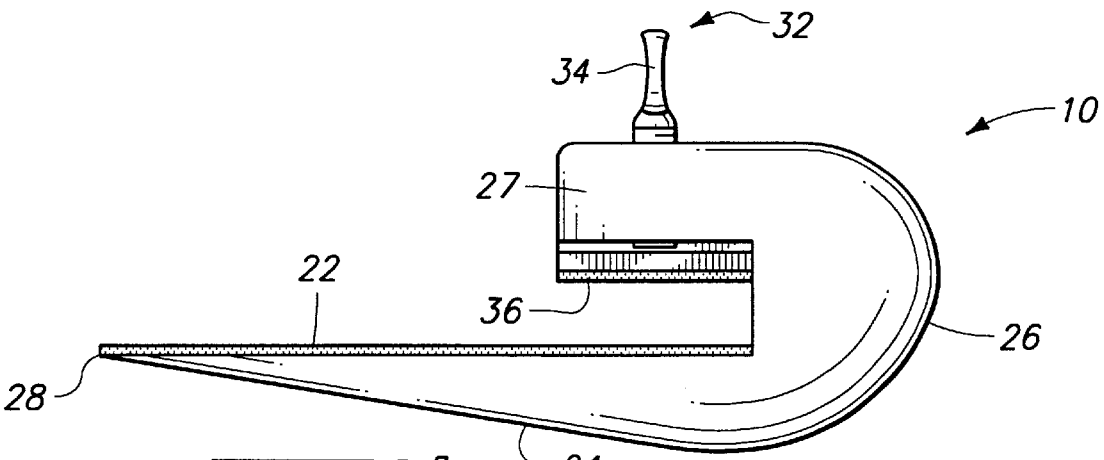
FIG. 4 is an end view thereof.
Figure 7:
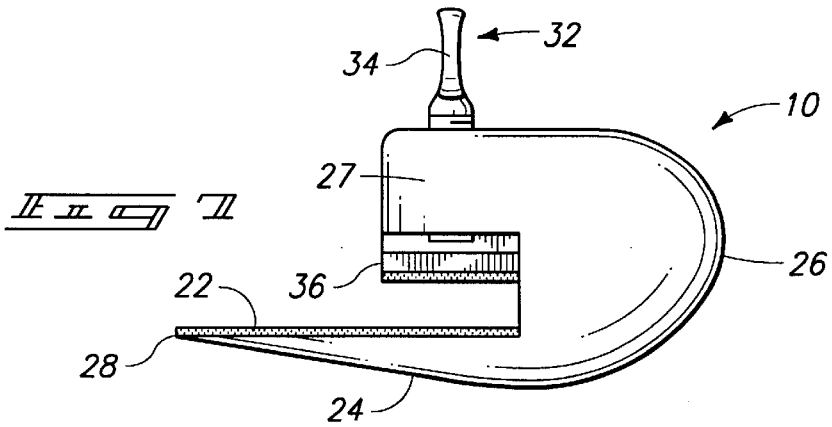
FIG. 7 is an end view of the alternate embodiment.

The leading edge 26 preferably includes a bullnose configuration that curves upwardly from the bottom surface 24, and leads to a top flange 27 that turns back toward the trailing edge 28 and thereby overlaps a portion of the top surface 22 (see FIGS. 4 and 7). The top surface 22 and top flange 27 define a snowboard receiving recess that is formed in the slider plate and configured to releasably receive and overlap a portion of a snowboard 12 adjacent a selected side edge 16.

Figure 11:
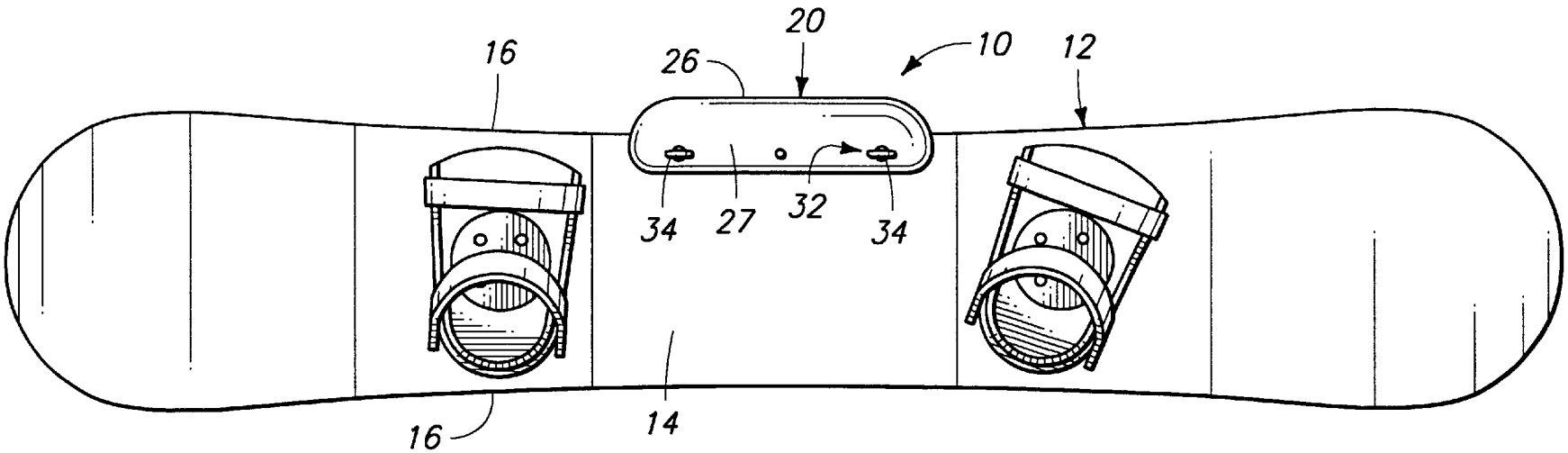
FIG. 11 is a diagrammatic sectional view illustrating a snowboard side edge digging into snow.
Figure 11:
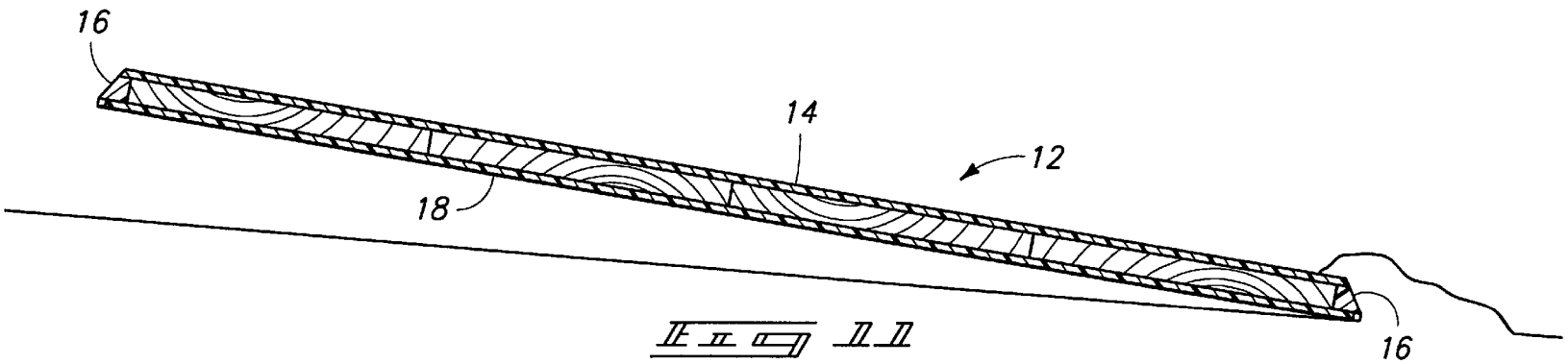
Figure 12:
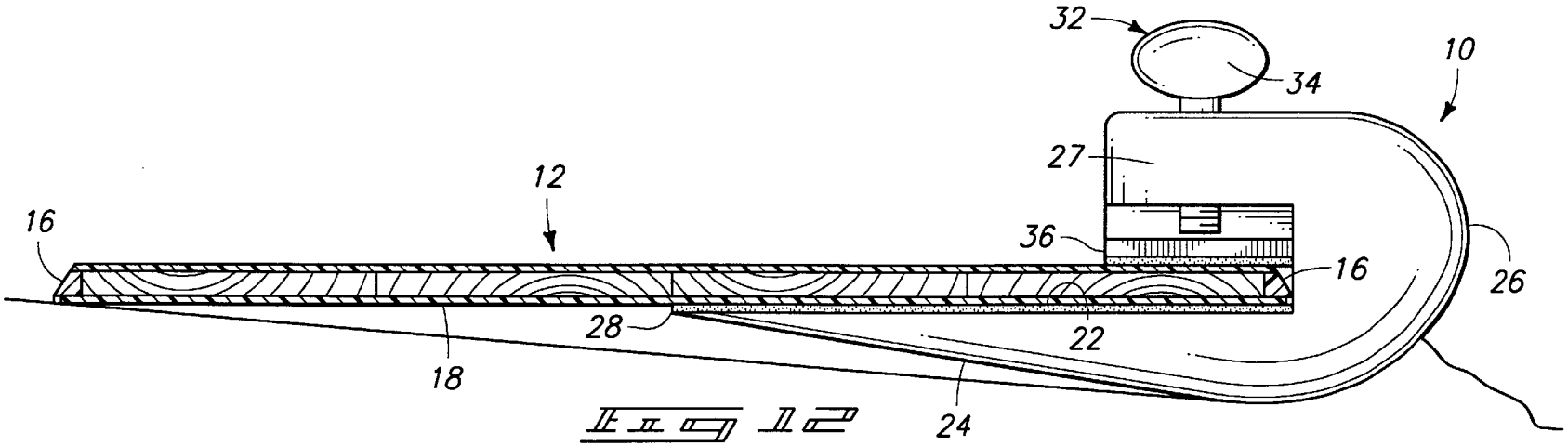
FIG. 12 is a view similar to FIG. 11 only showing a preferred form of the present attachment mounted to the snowboard and the resulting positioning of the snowboard during use.

FIG. 12 demonstrates an exemplary configuration in which the leading edge 16 of a snowboard 12 is received within the recess. With the snowboard edge thus confined, the bullnose will ride upwardly over snow and lift the snowboard side edge 16; thereby achieving the objective of preventing the edge from digging into the snow (as shown in FIG. 11). To further this objective, the bullnose curvature projects beyond the board edge 16 and curves upwardly to the leading edge 26 (FIG. 12). The curvature is such that when the attachment is mounted to a snowboard, the leading edge 26 is preferably situated elevationally even with or above the board side edge 16.

Although other shapes for the plate may be used, it is presently preferred that the plate be substantially rectangular in plan view (FIG. 2). Leading and trailing edges 26, 28 form long sides of the rectangular configuration. The end edges 30 form the adjoining short sides of the rectangular shape.

In the embodiments shown, both curvilinear and rectilinear elements are used, with the end edges 30 being joined to the leading edge 26 by appropriately rounded corners. Such curvature aids to prevent or at least minimize the possibility that the attachment 10 itself will dig into the snow during operation.

In addition to the above curved surfaces, it is preferred that the bottom surface 24 be tapered upwardly toward the end edges and trailing edges. Thus the plate has a maximum thickness dimension adjacent the leading edge and a minimum thickness dimension at the trailing edge 28. This is done to minimize chances that the attachment itself could dig into the snow and cause a spill.

Figure 3:
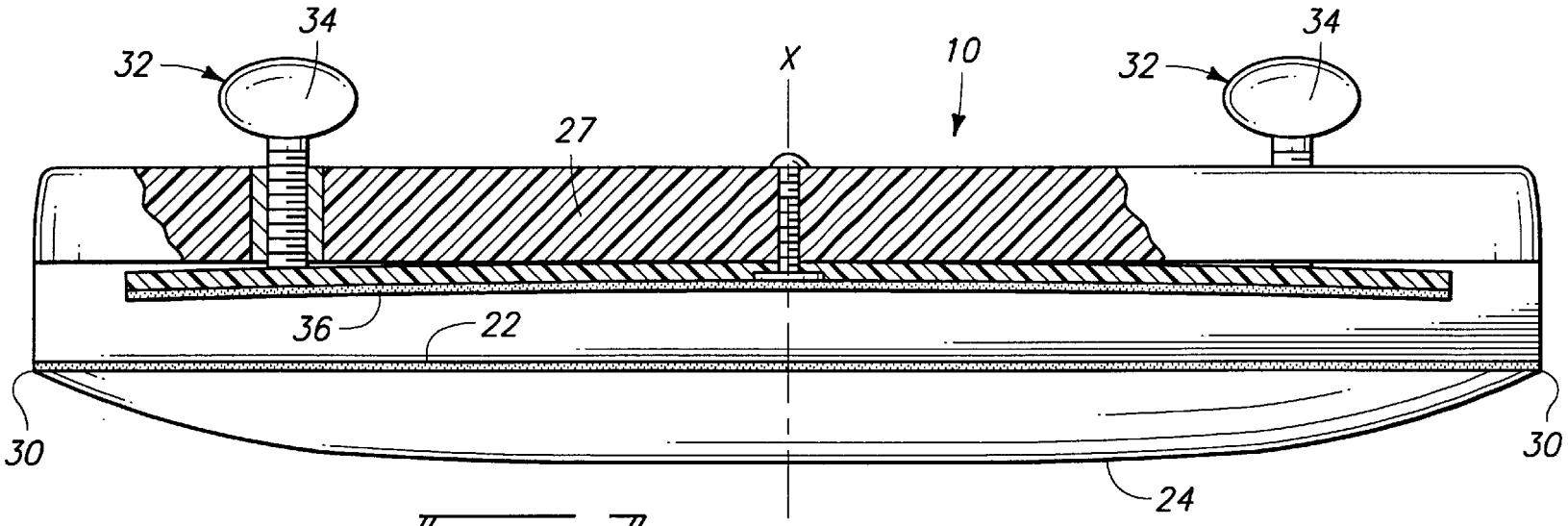
FIG. 3 is a partially fragmented side elevational view thereof.

It is advantageous that the slider plate 20 be substantially symmetrical about a plane X (FIGS. 2 and 3) that substantially bisects the slider plate and that is normal to the top surface 22. In other words, one half of the slider plate, on one side of the plane X is the substantial mirror image of the opposite half of the slider plate on the other side of the plane X. This is done to enable interchangeable positioning of the attachment along either side edge 16 of a snowboard.

It is further pointed out that the configuration shown is exemplary, and that other, preferably similarly symmetrical plate configurations may be used, including curvilinear, circular or kidney shapes in which the trailing and end edges would be joined substantially tangentially; or other rectilinear shapes could be used within the scope of our invention.

Preferred embodiments of the present attachment 10 will generally include a clamp 32, mounted to the slider plate 20 and configured to releasably secure the slider plate to a snowboard 12 with the top surface 22 engaging the base surface 18 of the snowboard.

In general, the clamp 32 may take numerous configurations that fall within the scope of our invention. Not shown but obvious variations could include cam clamps, overcenter lever clamps, wedge clamps, strapping with fasteners, or other clamp configurations that are conventional and known in the fastener arts.

In a presently preferred example, the clamp 32 is integral with the slider plate 20 and includes at least one clamp actuator 34 mounted to the slider plate 20, and a clamp foot 36 engaged by the clamp actuator. The clamp foot 36 is moveable in a snowboard gripping direction responsive to selective operation of the clamp actuator 34. In the example shown, two actuators 34 are used, comprised of thumbscrews, threadably engaging and passing substantially vertically through the top flange 27.

Bottom ends of the thumbscrews engage the clamp foot 36 which is simply comprised of a resilient strip of wood, plastic or spring metal attached at its longitudinal center to the flange within the recess. The thumbscrews are positioned adjacent either end of the foot to engage and selectively press the foot downwardly against that part of a snowboard placed within the recess. Appropriate high friction and scuff preventing liners (such as rubber sheeting) may be provided along facing surfaces of the clamp foot 36 and top surface 22 to prevent damage by the clamp and to hold the attachment against movement on the snowboard.

Given the above technical description, operation of the present attachment may be easily understood.

The attachment 10 is easily attached to a snowboard simply by sliding the attachment over a selected side edge of the board and by operating the clamp to secure the attachment in place. It is noted that the attachment may be secured to either side edge of the board, according to the user's preference. This capability is due to the identity of both board side edges 16, and since the attachment is substantially symmetrical about the plane X as discussed above.

The user may select either side edge of the snowboard to mount the attachment 10. The selection depends upon the direction the snowboarder is to be facing when training. Typically, the snowboarder will face one or the other edge of the snowboard according to the placement of the boot bindings mounted to the board. In the example illustrated in FIG. 1, the snowboarder is facing downhill and the attachment 10 is applied to the downhill edge of the snowboard. If the snowboarder is facing uphill, the orientation of the board will be reversed. However, the attachment 10 will still be mounted on the downhill side of the snowboard. This is done to accomplish lifting of the downhill edge substantially in the orientation shown in FIG. 12 and to avoid the situation illustrated in FIG. 11.

Figure 8:
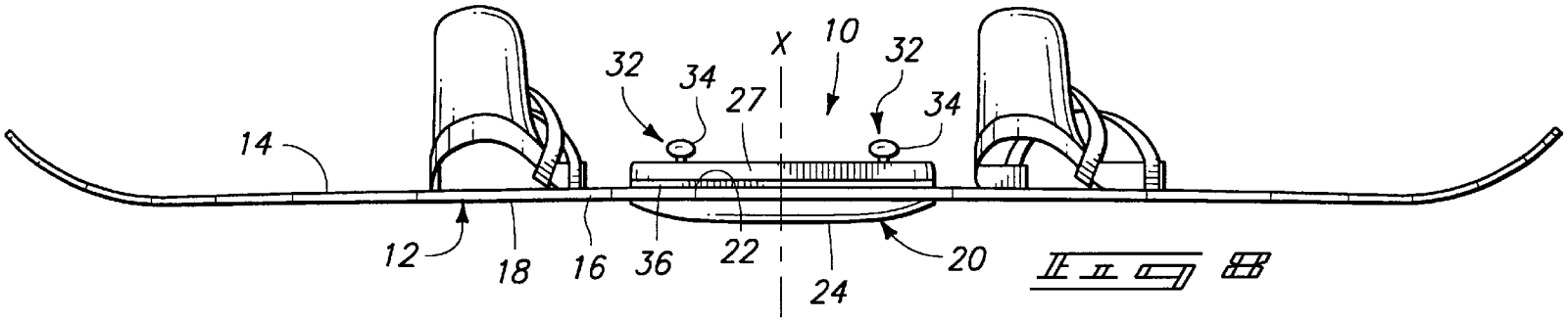
FIG. 8 is a side elevation view showing a preferred form of the present attachment mounted to a snowboard.

The attachment 10 is mounted to the snowboard at the approximate longitudinal center as shown in FIGS. 8–10. This may be done by eye as accurate placement is not critical.

The attachment is secured to the snowboard by placing the slider plate 20 with the top surface 22 in sliding engagement with the base 18 of the snowboard. The attachment is then slid onto the board until the side edge 16 "bottoms out" against the slider plate 20 within the board receiving recess. The clamp 32 is now operated to secure the attachment to the board.

In the preferred example shown, the clamp actuator 34 in the form of the thumbscrews is secured by turning the screws against the clamp foot 36. The clamp foot will deflect and move against the top deck 14 of the snowboard. This action will in turn pull the top surface 22 firmly upward in flush engagement with the snowboard base 18. The attachment is now firmly secured to the snowboard and the training procedure may take place.

The snowboarder, as shown in FIG. 1, may engage in various activities including the side slip, certain turns, and the like, with relative confidence that the leading or downhill edge of the snowboard will not dig into the snow and cause a spill. This is accomplished by the present attachment 10 in that it will engage the surface of the snow and tend to lift the downhill edge 16 of the board. If the snowboarder leans downhill, increasing pressure against the attachment 10 will gradually cause the board to depress the snow yet the leading edge will not quickly dig into the snow and abruptly stop the downhill slide. The snowboarder will very likely be aware of this incorrect motion and be able to make a correction before a spill occurs. Thus, the snowboarder may quickly learn proper balancing and weight distribution techniques without enduring the typical number of spills that usually occur during such training.

Once the snowboarder has mastered the techniques facing in one direction, the attachment 10 may be removed for further training, or it may be attached to the opposite edge for similar training with the snowboarder facing in the opposite direction. The mounting procedure is identical to that described above, and the dismounting procedure, for removing the attachment, is a simple reversal of the steps set forth above.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A snowboard instructional attachment, comprising:

a slider plate including a top surface and a bottom surface, the top surface being configured to be secured to a base surface of a snowboard and the bottom surface being configured to engage and slide across snow;

the slider plate further including a leading edge joining the bottom surface and extending upwardly from the bottom surface and configured to extend above a top deck surface of a snowboard when mounted thereto;

a movable clamping device mounted to the slider plate and manually adjustable to mechanically secure the slider plate to a snowboard along one longitudinal side edge thereof with the top surface engaging the base surface of the snowboard; and whereby the slider plate will support the one longitudinal side edge of the snowboard at an elevated position with respect to a remaining longitudinal side edge of the snowboard.

2. A snowboard instructional attachment as claimed by claim 1, wherein the slider plate is symmetrical about a plane that is normal to the top surface.

3. A snowboard instructional attachment as claimed by claim 1, wherein the movable clamping device is integral with the slider plate.

4. A snowboard instructional attachment as claimed by claim 1, wherein the movable clamping device is comprised of at least one clamp actuator mounted to the slider plate, and a clamp foot engaged by the clamp actuator and moveable in a snowboard gripping direction responsive to the clamp actuator.

5. A snowboard instructional attachment as claimed by claim 1, wherein the slider plate includes end edges and wherein the bottom surface tapers upwardly toward said end edges.

6. A snowboard instructional attachment as claimed by claim 1, wherein the slider plate includes a trailing edge spaced from the leading edge and end edges joining the leading and trailing edges and further comprising rounded corners joining the end edges and the leading edge.

7. A snowboard instructional attachment as claimed by claim 1, wherein the slider plate includes end edges and wherein the bottom surface tapers toward said end edges.

8. A snowboard instructional attachment mountable to a snowboard having opposed longitudinal side edges, a top deck surface and an opposed base surface, comprising:

a slider plate including a leading edge, a trailing edge, and end edges joining the leading and trailing edges;

the slider plate further including a top surface configured to fit substantially flush against the base surface of a snowboard, and an opposed bottom surface;

a movable clamping device mounted on the slider plate and manually adjustable to mechanically secure the slider plate to a snowboard along one of the opposed longitudinal side edges with the top surface in substantial flush engagement with the base surface of the snowboard and with the leading edge of the slider plate spaced outwardly of the one snowboard side edge; and wherein the leading edge of the slider plate is formed by a bullnose configuration curving upwardly from the bottom surface and configured to overlap the one side edge in order to elevate at least a portion of the one side edge of the snowboard and thereby aid in preventing the one snowboard side edge from digging into the snow during sideslip and certain turning maneuvers.

9. A snowboard instructional attachment as claimed by claim 8, wherein the slider plate is formed in a substantially rectangular configuration with the leading and trailing edges forming long sides of the rectangular configuration and the end edges forming short sides of the rectangular configuration.

10. A snowboard instructional attachment as claimed by claim 8, wherein the slider plate is formed in a substantially rectangular configuration with the leading and trailing edges forming long sides of the rectangular configuration and the end edges forming short sides of the rectangular configuration; and wherein the end edges taper upwardly from the bottom surface toward the top surface.

11. A snowboard instructional attachment as claimed by claim 8, wherein the bottom surface tapers upwardly from a location adjacent the leading edge toward the trailing edge.

12. A snowboard instructional attachment as claimed by claim 8, further comprising a top flange extending from the leading edge over the top surface and toward the trailing edge to form a snowboard receiving recess.

13. A snowboard instructional attachment as claimed by claim 8, further comprising:

a top flange extending from the leading edge over the top surface and toward the trailing edge to form a snowboard receiving recess; and a clamp member having a snowboard deck engaging surface, mounted on the top flange and selectively operable within the snowboard receiving recess to move the snowboard engaging surface toward the top surface in such a manner that a snowboard may be selectively gripped between the snowboard engaging surface and the top surface.

14. A snowboard instructional attachment mountable to a snowboard having a pair of opposed longitudinal side edges joining a top deck surface and an opposed base surface, comprising:

a slider plate including a convex low friction bottom surface joining a leading edge and a trailing edge, and further including a top surface formed for flush engagement against a snowboard base surface adjacent one side edge thereof;

wherein the slider plate is substantially symmetrical about a plane substantially bisecting the slider plate and normal to the top surface;

the slider plate including a thickness dimension between the top surface and bottom surface and wherein the thickness dimension adjacent the leading edge is greater than the thickness dimension adjacent the trailing edge;

the slider plate further including opposed end edges that include curved portions joining the leading edge;

wherein the leading edge of the slider plate includes a bullnose configuration curving upwardly from the bottom surface and leading to a top flange configured to overlap a portion of the top surface, the top surface and top flange defining a snowboard receiving recess formed in the slider plate and configured to releasably receive and overlap a portion of a snowboard adjacent a side edge thereof and with the bullnose projecting outwardly of one of the snowboard side edges; and a clamp on the top flange configured to secure the slider plate to a snowboard along the one snowboard side edge with the top surface in substantial flush engagement with the base surface of the snowboard and with the leading edge of the slider plate spaced outwardly of the one snowboard side edge.

* * * * *